US007111916B2

(12) United States Patent
Barry et al.

(10) Patent No.: US 7,111,916 B2
(45) Date of Patent: Sep. 26, 2006

(54) SYSTEM AND METHOD OF FLUID LEVEL REGULATING FOR A MEDIA COATING SYSTEM

(75) Inventors: Raymond Jay Barry, Lexington, KY (US); Michael Wesley Baskette, Lexington, KY (US); Gary Scott Overall, Lexington, KY (US); Steven Andrew Rice, Shelbyville, KY (US); Johnny Ray Sears, Midway, KY (US); Curtis Ray Droege, Richmond, KY (US); Randall Steven Gall, Lexington, KY (US); Andrew Charles Hogan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 201 days.

(21) Appl. No.: 10/084,256

(22) Filed: Feb. 27, 2002

(65) Prior Publication Data

US 2003/0160835 A1 Aug. 28, 2003

(51) Int. Cl.
*B41J 2/195* (2006.01)

(52) U.S. Cl. ..... 347/7; 347/86; 347/99

(58) Field of Classification Search ..... 347/7, 347/6, 5, 1, 15, 43, 106, 14, 19, 44, 45, 101, 347/105, 96, 86, 99, 9; 428/195, 212
See application file for complete search history.

(56) References Cited

U.S. PATENT DOCUMENTS

| | | | | |
|---|---|---|---|---|
| 2,288,720 A | | 7/1942 | Knowlton | |
| 3,222,209 A | | 12/1965 | Brudige et al. | |
| 4,449,476 A | | 5/1984 | Voswinckel et al. | 118/674 |
| 4,636,814 A | * | 1/1987 | Terasawa | 347/86 |
| 4,806,847 A | * | 2/1989 | Atherton et al. | 73/304 C |
| RE33,525 E | | 1/1991 | Kohashi | 346/76 |
| 5,396,275 A | | 3/1995 | Koike et al. | 347/101 |
| 5,403,358 A | | 4/1995 | Aston et al. | 8/448 |
| 5,406,356 A | | 4/1995 | Campbell et al. | 355/219 |
| 5,440,329 A | | 8/1995 | Meggitt et al. | 347/212 |
| 5,445,463 A | | 8/1995 | Paranjpe | 400/240 |
| 5,455,604 A | | 10/1995 | Adams et al. | 340/138 |
| 5,462,787 A | | 10/1995 | Yamamoto et al. | 428/195 |
| 5,489,928 A | * | 2/1996 | Takahashi et al. | 347/45 |
| 5,500,668 A | | 3/1996 | Malhotra et al. | 347/105 |
| 5,500,724 A | | 3/1996 | Campbell et al. | 355/297 |
| 5,505,776 A | | 4/1996 | Pichler et al. | 118/203 |
| 5,512,930 A | | 4/1996 | Brandt et al. | 347/212 |
| 5,521,002 A | | 5/1996 | Sneed | 428/331 |

(Continued)

FOREIGN PATENT DOCUMENTS

EP 0 726 156 A1 8/1996

(Continued)

*Primary Examiner*—Stephen Meier
*Assistant Examiner*—Lam S. Nguyen
(74) *Attorney, Agent, or Firm*—Needle & Rosenberg PC

(57) ABSTRACT

An apparatus for the management of the fluid level in a media coating system. In one embodiment, the apparatus has a supply item for the storage of a media coating fluid and an applicator having a trough for receiving the media coating fluid from the supply item. The apparatus utilizes a fluid level detection sensor that is located within the applicator to measure whether the media coating fluid level within the trough of the applicator is either above or below a threshold position and to generates an output signal. The apparatus has a controller for receiving the output signal and controlling delivery of the media coating fluid from the supply item to the applicator.

38 Claims, 12 Drawing Sheets

U.S. PATENT DOCUMENTS

| | | | | |
|---|---|---|---|---|
| 5,523,122 | A | 6/1996 | Harada et al. | 427/287 |
| 5,546,114 | A | 8/1996 | Tait et al. | 347/212 |
| 5,552,819 | A | 9/1996 | Brandt et al. | 347/212 |
| 5,561,454 | A | 10/1996 | Kurabayashi et al. | 347/105 |
| 5,563,644 | A | 10/1996 | Isganitis et al. | 347/102 |
| 5,582,087 | A | 12/1996 | Crowley et al. | 83/115 |
| 5,583,544 | A * | 12/1996 | Stamer et al. | 347/7 |
| 5,589,869 | A | 12/1996 | Brandt et al. | 347/212 |
| 5,614,933 | A | 3/1997 | Hindman et al. | 347/103 |
| 5,618,338 | A | 4/1997 | Kurabayashi et al. | 106/26 R |
| 5,619,240 | A | 4/1997 | Pong et al. | 347/103 |
| 5,623,294 | A | 4/1997 | Takizawa et al. | 347/98 |
| 5,623,718 | A | 4/1997 | Bracken et al. | 399/284 |
| 5,628,827 | A | 5/1997 | McCollam et al. | 118/695 |
| 5,633,045 | A | 5/1997 | Smith et al. | 427/428 |
| 5,635,969 | A | 6/1997 | Allen | 347/96 |
| 5,645,888 | A | 7/1997 | Titterington et al. | 427/256 |
| 5,651,620 | A | 7/1997 | Paranjpe | 395/352 |
| 5,676,363 | A | 10/1997 | Kishida et al. | 271/10.02 |
| 5,677,008 | A | 10/1997 | Kameya et al. | 427/428 |
| 5,677,067 | A | 10/1997 | Kojima et al. | 428/478.2 |
| 5,678,133 | A | 10/1997 | Siegel | 399/67 |
| 5,681,643 | A | 10/1997 | Noguchi et al. | 428/195 |
| 5,688,603 | A | 11/1997 | Iqbal et al. | 428/523 |
| 5,694,158 | A | 12/1997 | Kato et al. | 347/139 |
| 5,695,820 | A | 12/1997 | Davis et al. | 427/261 |
| 5,702,812 | A | 12/1997 | Bracken et al. | 428/323 |
| 5,708,943 | A | 1/1998 | Applegate et al. | 399/284 |
| 5,712,027 | A | 1/1998 | Ali et al. | 428/212 |
| 5,784,679 | A | 7/1998 | Schlueter, Jr. et al. | 399/335 |
| 5,797,318 | A | 8/1998 | Taylor et al. | 101/148 |
| 5,808,645 | A | 9/1998 | Reeves et al. | 347/103 |
| 5,825,378 | A | 10/1998 | Beauchamp | 347/19 |
| 5,827,577 | A | 10/1998 | Spencer | 427/475 |
| 5,882,131 | A | 3/1999 | Belon et al. | 400/662 |
| 5,908,505 | A | 6/1999 | Bargenquest et al. | 118/211 |
| 5,993,524 | A | 11/1999 | Nagai et al. | 106/31.27 |
| 6,002,909 | A | 12/1999 | Furuyama et al. | 399/328 |
| 6,024,428 | A * | 2/2000 | Uchikata | 347/7 |
| 6,094,557 | A | 7/2000 | Shinohara | 399/302 |
| 6,164,746 | A * | 12/2000 | Akahira et al. | 347/15 |
| 6,183,079 | B1 | 2/2001 | Meade et al. | 347/101 |
| 6,428,157 | B1 * | 8/2002 | Wen | 347/101 |
| 6,444,270 | B1 | 9/2002 | Naruse | 427/359 |

FOREIGN PATENT DOCUMENTS

| | | | |
|---|---|---|---|
| EP | 0 778 321 | A2 | 6/1997 |
| EP | 0 822 094 | A2 | 2/1998 |
| JP | 63 299971 | A | 12/1988 |
| JP | 05131646 | * | 5/1993 |
| WO | WO 99/64243 | | 12/1999 |

* cited by examiner

SYSTEM AND METHOD OF FLUID LEVEL REGULATING FOR A MEDIA COATING SYSTEM

BACKGROUND OF THE INVENTION

1. Field of the Invention

The present invention generally relates to a method and apparatus for fluid level regulation in a media coating system. More particularly, the present invention relates to a method and apparatus for sensing and regulating liquid ink and coating levels in an inkjet printing system and maintaining the satisfactory operation thereof.

2. Background Art

Drop-on-demand ink jet printers use thermal energy to produce a vapor bubble in an ink-filled chamber to expel a droplet. A thermal energy generator or heating element, usually a resistor, is located in the chamber on a heater chip near a discharge nozzle. A plurality of chambers, each provided with a single heating element, are provided in the printer's print head. The print head typically comprises the heater chip and a nozzle plate having a plurality of the discharge nozzles formed therein. The print head forms part of an ink jet print cartridge that also comprises an ink-filled container.

Ink jet printers have typically suffered from two major shortcomings. First, optical density of a printed image varies greatly with the print media or substrate being printed upon. Second, ink drying time is excessive on some media types.

Interaction between the ink and print media or substrate influences the performance of the ink jet printer. Different media types behave differently with the ink and not all media types are well suited for ink jet printing. Accordingly, attempts have been made to apply a liquid coating to the media before printing that interacts with the ink to improve the quality of the resulting printed image. The ink may contain, for example, penetrants to improve dry time and binders to improve performance. These "pre-coating" liquids may contain materials that cause the ink to flocculate on the surface of the media, improving image quality. Pre-coating liquids have previously been applied to the print media using a separate ink jet print head and by the use of a roll coating apparatus that directly contacts the print media prior to ink application. One roll coating apparatus and method of the prior art is shown and described in U.S. Pat. No. 6,183,079, assigned to Lexmark International, Inc.

Thus, a primary function of the media coating device is to deliver a uniform coat of specialized fluid to the print medium prior to printing. As the media is printed on, the interaction of the fluid and the ink results in superior optical density and faster dry time. As this specialized fluid is delivered to the coating device through a supply item, it becomes necessary to detect the presence of the supply item, and detect, maintain and control the level of the fluid within the coating device for it to perform properly. In particular, when the specialized fluid in the device's reservoir is depleted, timely refill should be conducted. In doing so, overfill should be avoided, and normal printing processes should not be interrupted.

Accordingly, there is a need for an apparatus for fluid level management in a media coating system for an inkjet printer that is capable of detecting, maintaining, filling and controlling the level of the specialized fluid in the media coating system.

SUMMARY OF THE INVENTION

The present invention, in one aspect, relates to an apparatus for fluid level management in a media coating system. In one embodiment, the apparatus has a supply item for the storage of a media coating fluid and an applicator having a trough for receiving the media coating fluid from the supply item. The apparatus utilizes a fluid level detection sensor that is located within the applicator to measure whether the media coating fluid level within the trough of the applicator is either above or below a threshold position and to generate an output signal. The apparatus has a controller for receiving the output signal and controlling delivery of the media coating fluid from the supply item to the applicator.

In another aspect, the present invention relates to a fluid level detection sensor for measuring a media coating fluid level in a media coating system, wherein the media coating system has an applicator with a trough to contain the media coating fluid and the fluid level detection sensor is located within the applicator. According to one embodiment of the present invention, the fluid level detection sensor includes a first probe having a connecting end, a measuring end and a body therebetween, and a second probe having a connecting end, a measuring end and a body therebetween.

The first probe and the second probe are spaced apart from each other and the measuring end of the first probe is positioned higher than the measuring end of the second probe such that an impedance between the measuring end of the first probe and the measuring end of the second probe can be measured. The first probe and the second probe are made from conducting material such as stainless steel. Note, the first probe and the second probe can also be positioned at the same level.

Moreover, each of the measuring end of the first probe and the measuring end of the second probe has a surface contactable with the media coating fluid, and the impedance between the measuring end of the first probe and the measuring end of the second probe depends on the area of the surface of each of the measuring ends that is in contact with the media coating fluid. When at least one of the first probe and the second probe is not in contact with the media coating fluid within the trough of the applicator, the measured impedance between the measuring end of the first probe and the measuring end of the second probe is high. Conversely, when both of the first probe and the second probe are in contact with the media coating fluid within the trough of the applicator, the measured impedance between the measuring end of the first probe and the measuring end of the second probe is low.

The fluid level detection sensor also has an oscillator having an output, wherein the output is electrically coupled to the connecting end of the first probe and a detector having an input and an output. The input of the detector is electrically coupled to the output of the oscillator and the connecting end of the first probe for receiving a signal related to the measured impedance between the measuring end of the first probe and the measuring end of the second probe and the output generates an output signal.

An embodiment of the present invention comprises a relaxation oscillator formed using a comparator. The oscillator outputs an AC signal through a resistor and a capacitor.

In a further embodiment, the detector includes a field-effect transistor having a drain, a gate and a source, wherein the source of the field-effect transistor is grounded and the gate is electrically coupled to the output of the oscillator, and a frequency discriminator having an input electrically coupled to the drain of the field-effect transistor and an output. The field-effect transistor receives an output signal having a frequency from the oscillator output and allows the output signal to pass if the amplitude of the output signal is greater than a gate threshold voltage, and the frequency discriminator receives the output signal and at the output generates a logic low if the frequency of the oscillator output is higher than a threshold frequency, or a logic high if the frequency of the oscillator output is lower than the threshold frequency, respectively. On the other hand, if the amplitude of the output signal is smaller than the threshold gate voltage, the field-effect transistor blocks the output signal. The detector may further include a capacitor that is electrically coupled between the output of the oscillator and the gate of the field-effect transistor.

The fluid level detection sensor may also have a fail-safe circuit performing a closed-loop status verification test to verify if the fluid level detection sensor is functioning properly before the applicator is filled with the media coating fluid. In one embodiment, the first probe has at least one wire, and the second probe has at least one wire. The fail-safe circuit has a transistor having a drain, a gate and a source and a capacitor electrically coupled between the drain of the transistor and a second wire of the first probe, wherein the source of the transistor is electrically coupled to a second wire of the second probe, and the gate of the transistor is adapted to receive a control signal. The first and second wires of both probes are isolated from each other, respectively, by means such as nylon washer so that the first and second wire can contact each other through the probe body.

A further aspect of the present invention relates to a method for fluid level management in a media coating system, wherein the media coating system has an applicator with a trough to contain the media coating fluid. The method includes the steps of determining media coating fluid level within the applicator against a predetermined upper refill limit and a predetermined lower refill limit, and selectively transferring media coating fluid from a supply item to the trough of the applicator depending on the level of the media coating fluid against the predetermined upper refill limit and the predetermined lower refill limit and the status of the media coating system.

In one embodiment of the present invention the step of determining media coating fluid level includes the steps of measuring media coating fluid level within the applicator, generating a signal indicating that the fluid level is low if the media coating fluid level is lower than the predetermined upper refill limit; counting the number of pages coated since the fluid level reaches the predetermined upper refill limit; and determining if a media coating request is received.

Additionally, a further embodiment comprises the step of selectively transferring media coating fluid, when a media coating request is received, including the steps of holding a media coating operation responsive to the media coating request if the number of pages coated since the fluid level reaches the predetermined upper refill limit exceeds a first page number corresponding to the predetermined lower refill limit, and transferring media coating fluid from a supply item to the trough of the applicator.

As yet another embodiment comprises the step of selectively transferring media coating fluid, when a media coating request is received, including the steps of holding a media coating operation responsive to the media coating request if the number of pages coated since the fluid level reaches the predetermined upper refill limit is greater than the first page number corresponding to the predetermined upper refill limit but smaller than a second page number, and transferring media coating fluid from a supply item to the trough of the applicator when the media coating operation is accomplished.

Moreover, the step of transferring media coating fluid further comprises coating fluid, when a media coating request is received, includes the steps of holding the media coating operation responsive to the media coating page request once the number of pages coated is greater than the first page number corresponding to the predetermined lower refill limit, and transferring media coating fluid from a supply item to the trough of the applicator.

Furthermore, the step of selectively transferring media coating fluid, when a media coating request is not received, includes the steps of: transferring media coating fluid from a supply item to the trough of the applicator if the number of pages coated is greater than the second page number corresponding to the predetermined high refill limit.

In another embodiment, the method further includes the steps of detecting the presence of the supply item, and detecting the presence of the media coating fluid in the supply item. If no media coating fluid is detected in the supply item, the method further includes the step of replacing the supply item with a new supply item.

In yet a further aspect, the present invention relates to a system for fluid level management in a media coating system, wherein the media coating system has an applicator with a trough to contain the media coating fluid. The system has means for determining media coating fluid level within the applicator against a predetermined upper refill limit and a predetermined lower refill limit, and means for selectively transferring media coating fluid from a supply item to the trough of the applicator depending on the level of the media coating fluid against the predetermined upper refill limit and the predetermined lower refill limit and the status of the media coating system.

In one aspect, the present invention relates to a method for fluid level management in a media coating system, wherein the media coating system has an applicator with a trough to contain the media coating fluid. The method includes the steps of determining media coating fluid level within the applicator against a predetermined upper refill limit and a predetermined lower refill limit; determining whether a media coating operation is in progress, and transferring media coating fluid from a supply item to the trough of the applicator when the level of the media coating fluid is lower than the predetermined lower refill limit and a media coating operation is in progress.

In another aspect, the present invention relates to a system for fluid level management in a media coating system, wherein the media coating system has an applicator with a trough to contain the media coating fluid. The system has means for determining media coating fluid level within the applicator against a predetermined upper refill limit and a predetermined lower refill limit, means for determining whether a media coating operation is in progress, and means for transferring media coating fluid from a supply item to the trough of the applicator when the level of the media coating fluid is lower than the predetermined lower refill limit and a media coating operation is in progress.

These and other aspects will become apparent from the following description of the various embodiments taken in conjunction with the following drawings, although variations and modifications may be effected without departing from the spirit and scope of the novel concepts of the disclosure.

DETAILED DESCRIPTION OF THE INVENTION

Figure 1:
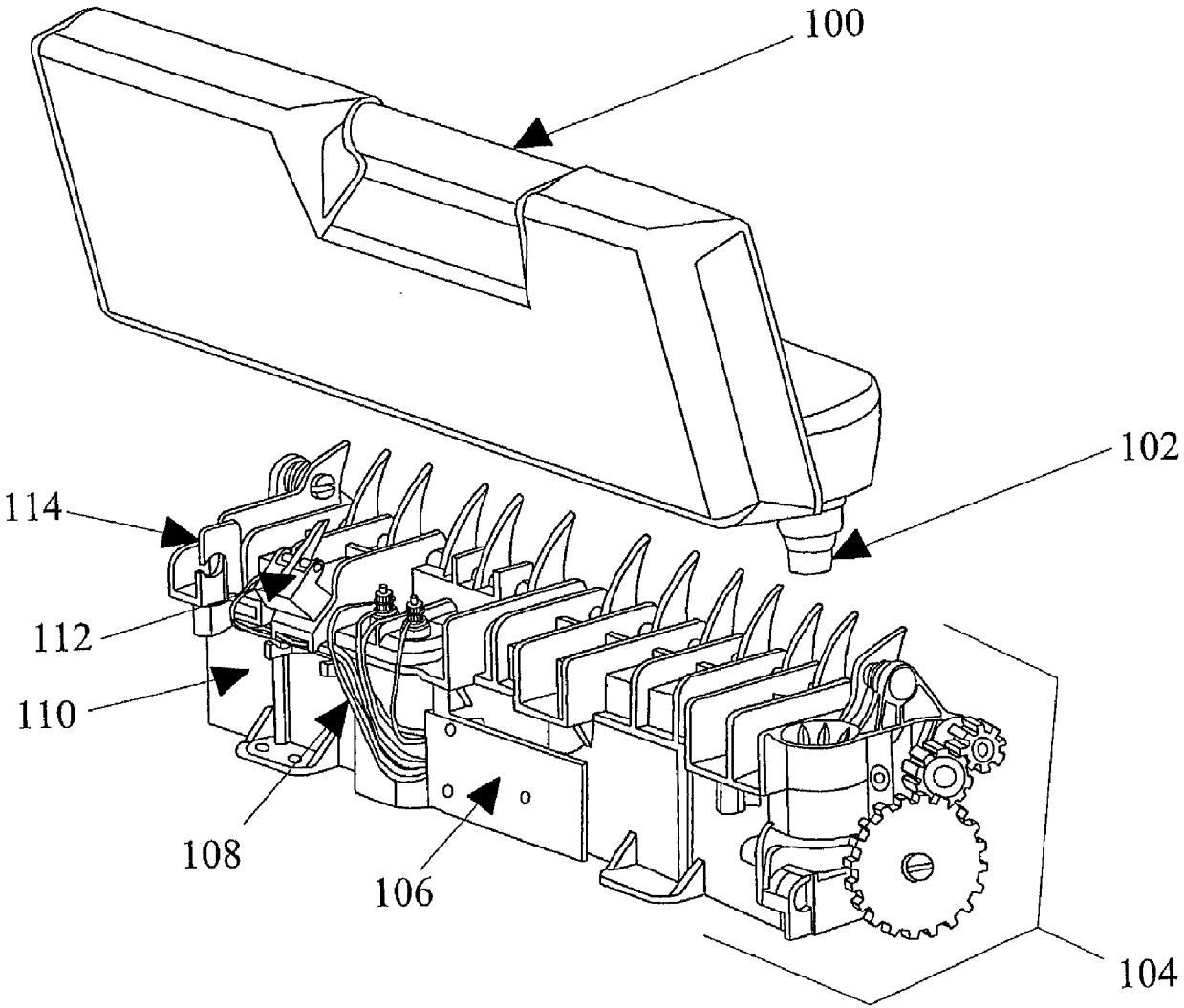
FIG. 1 is a perspective view of a media coating apparatus according to one embodiment of the present invention.

Several embodiments of the invention are now described in detail. The disclosed embodiments are intended as illustrative only since numerous modifications and variations therein will be apparent to those skilled in the art. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

The present invention, in one aspect, is an ink jet printer including a coating apparatus (FIG. 1) for applying a coating liquid to a printing substrate (not shown) prior to printing. In the embodiment described here, the coating device forms one of two selectable media paths. One media path is through the applicator and a second path bypasses the applicator. The selectable paths allow media that does not require coating to avoid the applicator and also allows for the applicator to be shut down if the applicator runs out of coating fluid. The ink jet printer comprises a printing apparatus (not shown) located in a print zone within a printer housing (not shown). The printer apparatus includes an ink jet print cartridge (not shown) supported in a carrier (not shown), which, in turn, is supported on a guide rail (not shown). A drive mechanism (not shown) including a drive belt is provided for effecting reciprocating movement of the carrier and the print cartridge back and forth along the guide rail. As the print cartridge moves back and forth, it ejects ink droplets onto a printing substrate provided below it. Substrates capable of being printed upon by the printer include commercially available plain office paper, specialty papers, envelopes, transparencies, labels, card stock and the like. A more detailed disclosure of the printing apparatus, printer housing, cartridge, carrier, guide rail and drive mechanism is set out in U.S. Pat. No. 6,183,079, assigned to Lexmark International, Inc. ("the '079 disclosure"), which is incorporated by reference therein.

Among other things, the present invention provides the following features:

Tracking and Control of Fluid Level With Minimal Feedback—With a simple two-state sensor that provides the indication that the fluid level is simply either above or below a threshold position, the present invention can control the fluid level to stay within a broader range. After fluid drops within an applicator of a coating apparatus, as it is being deposited on a printing substrate, an algorithm is utilized to calculate the fluid volume consumption per printed page and continually recalculate the remaining fluid volume in the reservoir. In order to prevent frequent small refill operations, the algorithm allows the fluid to drop to a minimal-acceptable level before another refill is attempted.

Logical Determination of Supply Item Status—An empty supply item is determined when a predetermined number of fill attempts fails to signify proper fluid level in the applicator. If this condition exists when the supply item is known to be present, an algorithm is utilized to determine that the supply item is indeed empty without direct measurement of the fluid level in the supply item. The algorithm can also be utilized to estimate a discreet fluid level contained in the supply item. By maintaining a consistent coat weight and knowing when a full supply item is installed, one can determine the remaining fluid level in the supply item.

Opportunistic Filling—The refill operation associated with a coating apparatus can interrupt and delay a print job. Thus, it is desirable to perform refills at times that minimize the possibility of printer delays. This is accomplished by avoiding refill operations during active printer times until the fluid level reaches an absolute minimum acceptable level. In addition, fluid is more likely added to "top off" the applicator during printer idle times. This is accomplished by having two fluid-level decision points, one low level that forces a refill under any condition and another, much higher level, that triggers a refill operation only if the printer is idle. In addition, the coating apparatus makes use of the printer power-on cycle time to refill the applicator if it is not completely full.

Fail Safe—An overfill of the reservoir of the coating fluid is considered as a failure of the system and should be avoided. Overfills may result in degraded print quality and fluid spills. It is important that if there is any failure of the system, the failure should make it appear to the system that the fluid level is full so that a refill operation is not attempted. A complete closed-loop verification of the system is performed before any refill attempt. This is accomplished by electronically shorting the sense probes through a fail safe circuit that has separate and isolated set of wires. In one embodiment, the present invention provides a four-wire configuration coupling to the two probes of the sensor.

Probe Isolation—According to the present invention, in one embodiment, the probes of a fluid level detection sensor in a coating apparatus measure the conductance between themselves to determine if fluid has reached the probes, therefore it is also possible that fluid contamination on the walls of the reservoir could appear as a conduction path, thus appearing as a full reservoir, which may prevent needed refills. This is a fail-safe mode, but if contamination does occur, it is desirable that the false conduction path dissipates in a reasonable period of time. This can be accomplished by proper isolation of the probes. In one embodiment, the geometry of the probe mountings attempts to maximize the total surface distance between the exposed metal of the sense probe and the ground probe. In addition, a large portion of this surface distance is composed of vertical surfaces, which may drain and dry more quickly.

These and other features of the present invention are described in more detail below.

Hardware Components of the Invention

Figure 2:
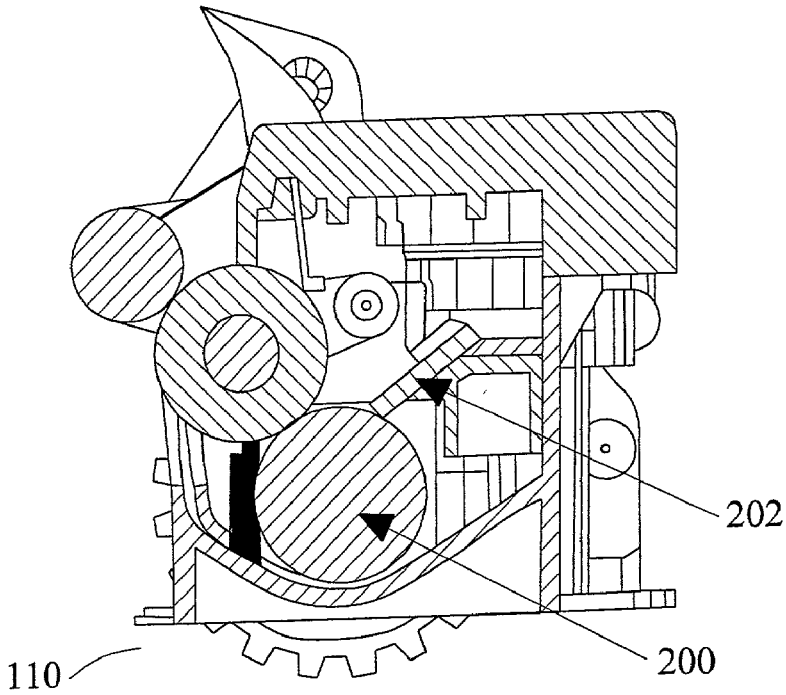
FIG. 2 is a partial side elevation view of a media coating apparatus as shown in FIG. 1.

The hardware associated with this invention may be described by tracing the path of a coating fluid. The present invention is initially described with reference to FIGS. 1 and 2. In FIGS. 1 and 2, the fluid is originally contained in a supply item, referred to as the "cartridge" 100. In one embodiment, the cartridge 100 contains approximately 700 cc of the specialized coating fluid and is blow molded out of plastics such as Polypropylene. The cartridge 100 features a threaded snout for the retention of the valve assembly 102 that releases fluid to a coating device 104. The coating device 104 is subsequently referred to as the "applicator" 104 when it is actuated. The cartridge 100 is installed within the printer by the user and is held in position by latches that reside in the main frame assembly of the printer (not shown). An optical sensor 112, with a spring-loaded arm, is mounted on top of the applicator 104. It is secured to an angled surface of the applicator's 104 top housing 114. This configuration allows for the maximum rotational travel of the optical sensor's 112 spring-loaded arm. When the user installs the cartridge 100 into the printer the spring-loaded arm is deflected and the sensor 112 is tripped, thus signifying presence of the cartridge 100 within the system.

The specialized coating fluid is delivered to the applicator 104, through the valve assembly 102 in the cartridge 100. As the fluid passes into the applicator 104, it is contained in a trough that is referred to as the bottom housing 110. The bottom housing 110 is a box made out of plastics, such as Noryl that contains 20% glass fibers. As the fluid fills the bottom housing 110, other parts contained in the bottom housing 110 are also exposed to the coating fluid. The specialized coating fluid's primary interface is with the applicator's 104 grit roll 200 (shown as a cross section in FIG. 2). The level of the fluid relative to the grit roll 200 is important in this application. Essentially, if enough fluid is not deposited into the trough, the grit roll 200 will not be exposed to the fluid and thus will not only be prevented from coating the media, but may also damage the doctor blade 202 by tearing material from it's doctoring edge. Conversely, if too much fluid is deposited into the bottom housing 110, print quality defects may occur as well as a leaking of the fluid outside of the applicator 104, which may result in damage to the printer's hardware.

Figure 3:
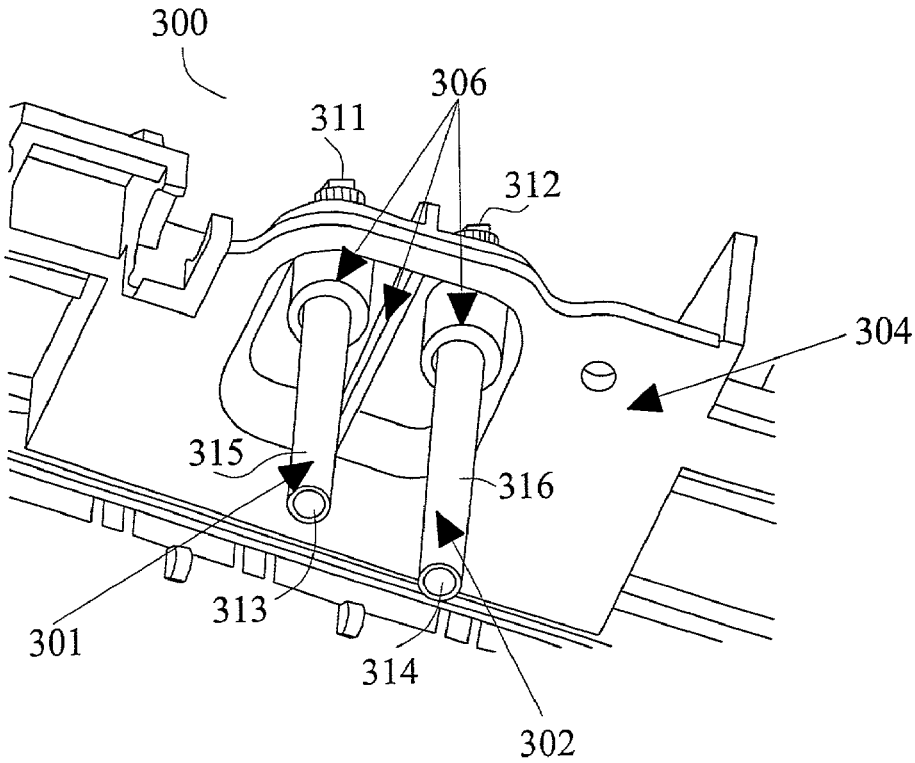
FIG. 3 is a lower perspective view of a fluid level detection sensor according to one embodiment of the present invention.
Figure 4:
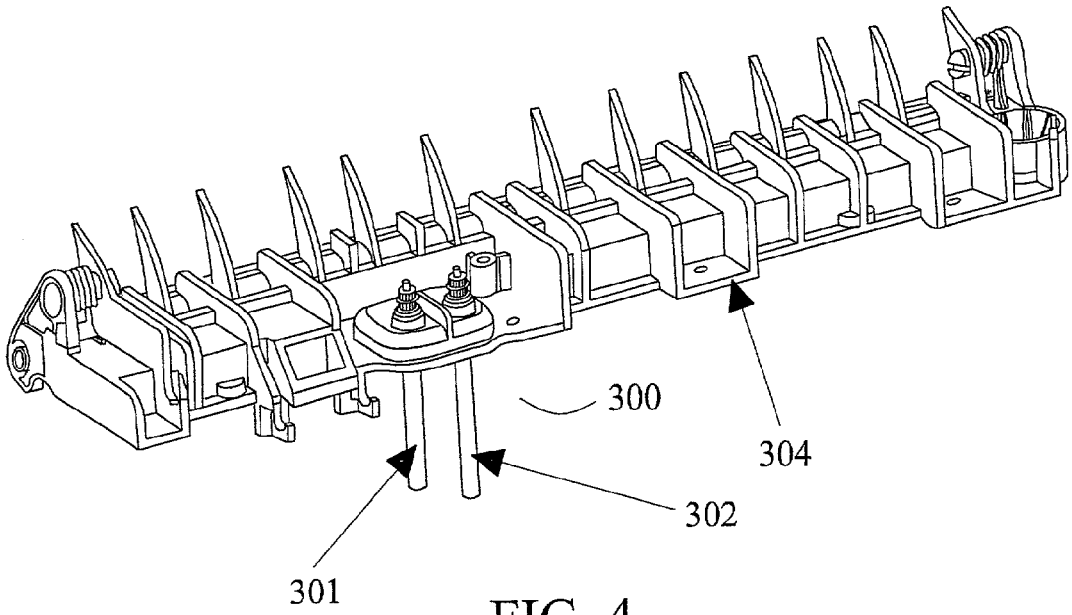
FIG. 4 is an upper perspective view of a fluid level detection sensor as shown in FIG. 3.

There are many different ways to sense the level of the fluid as it fills in the bottom housing 110. With reference to FIGS. 3 and 4, we illustrate how the inventive implementation uses a conductive method in which two probes are utilized. In one embodiment, the present invention provides a fluid level detection sensor 300. The sensor comprises a sense probe 301 and a ground probe 302. The fluid level of the coating fluid is determined by measuring the impedance between the sense probe 301 and the ground probe 302 in order to determine if the set of probes are in contact with the fluid. In the event that the coating fluid comes into contact with both probes, the measurement indicates that the fluid has reached the desired level.

As shown in FIGS. 1–4, in another aspect, the fluid level detection sensor 300 can be utilized for measuring a media coating fluid level in a media coating system, wherein the media coating system has an applicator 104 with a trough 110 to contain the media coating fluid and the fluid level detection sensor 300 is located within the applicator 104. According to one embodiment of the present invention, the fluid level detection sensor 300 includes a first probe or sense probe 301 having a connecting end 311, a measuring end 313 and a body 315 therebetween, and a second probe or ground probe 302 having a connecting end 312, a measuring end 314 and a body 316 therebetween.

The first probe 301 and the second probe 302 are spaced apart from each other and the measuring end 313 of the first probe 301 is positioned higher than the measuring end 314 of the second probe 302 such that an impedance between the measuring end 313 of the first probe 301 and the measuring end 314 of the second probe 302 can be measured. The first probe 301 and the second probe 302 are made from conducting material such as stainless steel.

Moreover, each of the measuring end 313 of the first probe 301 and the measuring end 314 of the second probe 302 has a surface contactable with the media coating fluid, and the impedance between the measuring end 313 of the first probe 301 and the measuring end 314 of the second probe 302 depends on the area of the surface of each of the measuring ends 313, 314 that is in contact with the media coating fluid. When at least one of the first probe 301 and the second probe 302 is not in contact with the media coating fluid within the trough 110 of the applicator 104, the measured impedance between the measuring end 313 of the first probe 301 and the measuring end 314 of the second probe 302 is high. Conversely, when both of the first probe 301 and the second probe 302 are in contact with the media coating fluid within the trough 110 of the applicator 104, the measured impedance between the measuring end 313 of the first probe 301 and the measuring end 314 of the second probe 302 is low. The data collected from the measurements can be received in a sensor circuit for analysis, which is discussed in detail below.

Proper isolation of the sense probe 301 and the ground probe 302 is required in order to prevent the fluid from forming a conductive path in the event that the unit tips over or if fluid contained within the bottom housing 110 is splashed. The existence of such a conductive path may result in the sensor 300 registering a "false full" reading within the bottom housing 110. This sensor failure mode may be designed to be time dependent. In one embodiment of the present invention, the sensor's recovery time as the result of a physical jarring can be reduced to a recovery time of 5 minutes or less. Additional factors that may attribute to this conductive path phenomenon are the wettability of the surface (features such as surface tension/energy balance and surface finish), fluid viscosity, vertical features and "drip edge" features.

The sense probe 301 and the ground probe 302 can be made from materials that are corrosion resistant such as stainless steel. In one embodiment, the probes are made from stainless steel where a coating fluid that is high in salts is utilized. In such a situation it is highly desirable that the probes that are utilized be corrosion resistant in order to ensure the proper operation of the sensor. In one embodiment, the probes 301, 302 are mounted within a glass-filled Noryl housing that has four vertical surfaces (not shown) with a combined vertical height of approximately 30 mm. The coating fluid has a resistance of about 1 kΩ and viscosity of about 45 cP. In a momentary tipping or re-orienting event, with this embodiment, the resistance from probe to probe has a slope of 3.3 kΩ per minute. This may result in a recovery time of approximately ⅓-minute, which is a reasonable constraint.

Figure 4A:
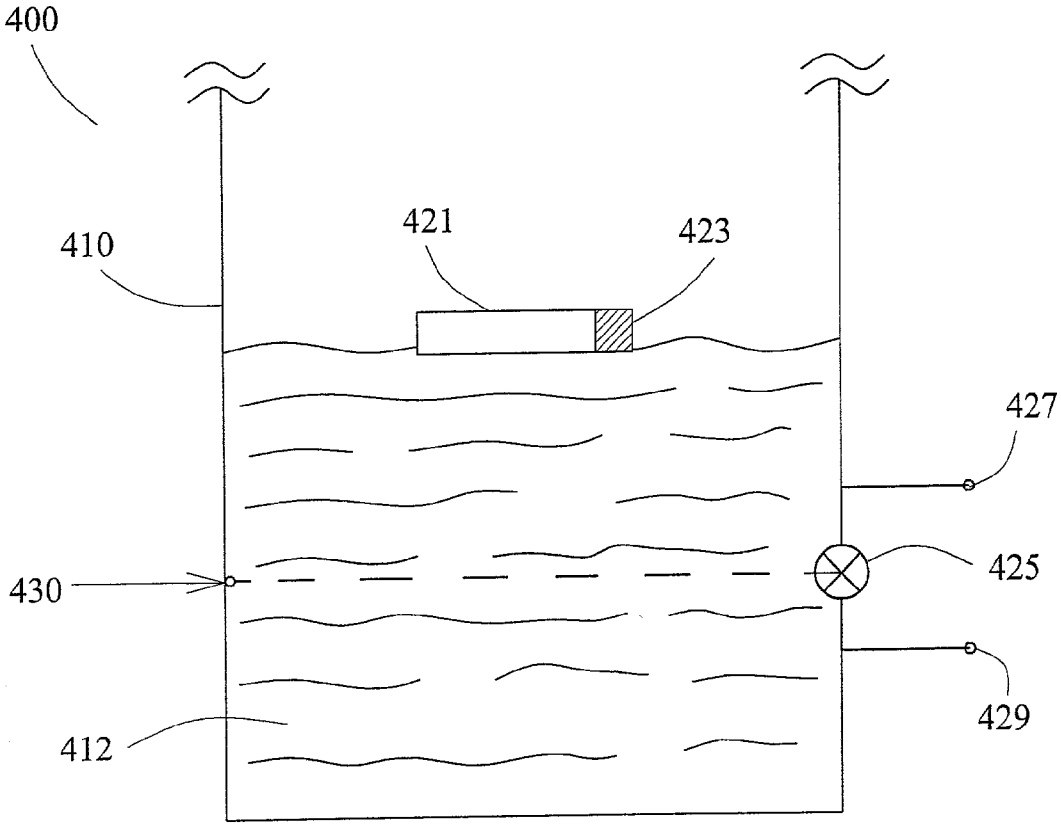
FIG. 4A is a view of an alternative embodiment of FIG. 4 in which a fluid level detection sensor utilizes a float magnet.

Alternatively, the fluid level detection sensor can comprise a single point level sensor. In one embodiment shown in FIG. 4A, a single point level sensor 400 includes a float 421 and a magnet 423 associated with the float 421 generating a magnetic field. The single point level sensor 400 also has a magnetic switch 425 that is positioned in the inside surface of the trough 410 substantially near or at a threshold position 430. The float 421 floats on the surface of a media coating fluid 412. When the coating fluid 412 is consumed, the level of the coating fluid 412 moves toward to the threshold position 430 and so does the float 421. When the float 421 moves sufficiently close to the magnetic switch 425, the magnetic switch 425 is activated by the magnetic field of the magnet 423, thereby generating an output signal at outputs 427, 429 indicating the level of the coating fluid 412 within the trough 410. The magnetic switch 425 can be a Hall effect switch, or a reed switch. Factors that may affect this sensor design configuration are the density and foamability (reduces density) of the coating fluid, the effective float density, and varied float stability criteria.

Additional alternative level sensors may include capacitance, thermistor, ultrasonic and optical sensors and the like.

Implementation of the Sensor Circuit

Figure 5:
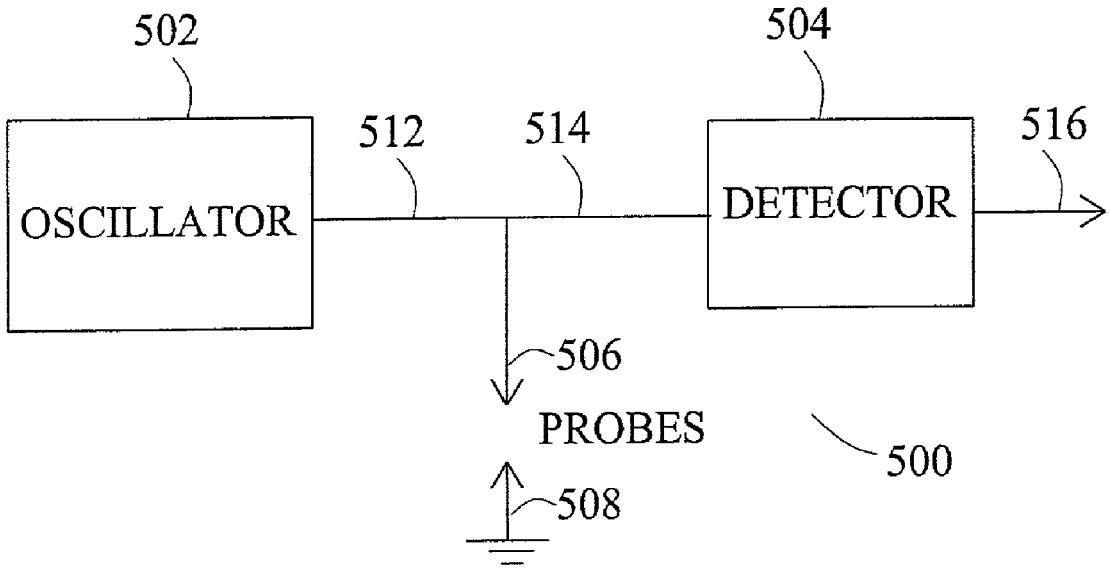
FIG. 5 is a block diagram for a sensor circuit utilizing a fluid level detection sensor as shown in FIG. 3.
Figure 6:
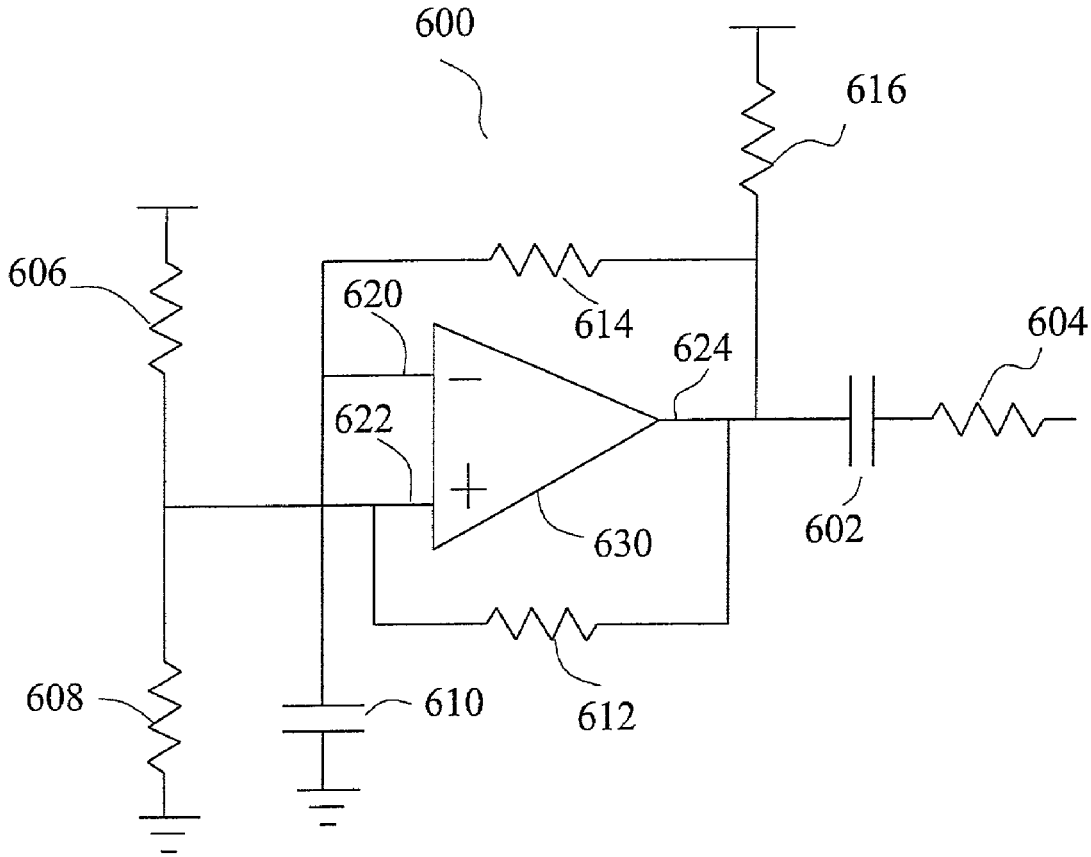
FIG. 6 is a block diagram for an oscillator circuit that can be utilized in the sensor circuit as shown in FIG. 5.
Figure 7:
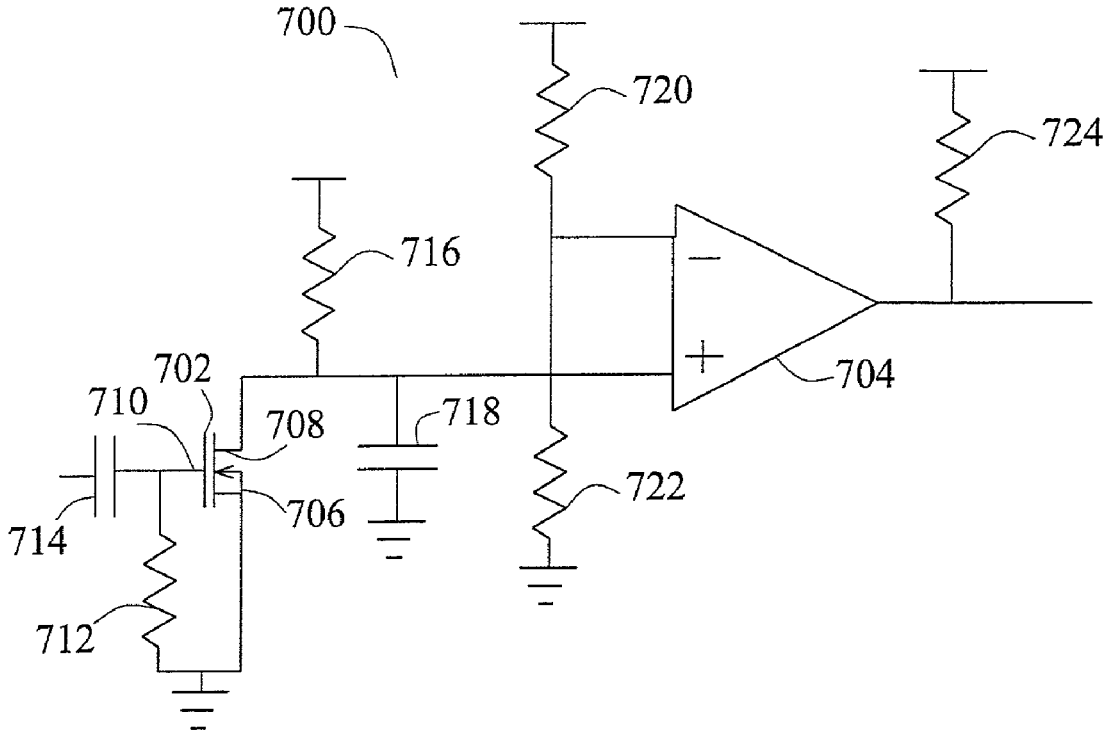
FIG. 7 is a block diagram for a detector circuit that can be utilized in the sensor circuit as shown in FIG. 5.

With reference to FIGS. 5, 6 and 7, we will next examine the fluid level sensor circuit that may be utilized within the system. As shown in FIG. 5, the basic sensor circuit 500 of the present invention comprises an oscillator 502 and a detector 504 that are operably connected to a first 506 and a second 508 probe. The sensor 500 measures the impedance between the two metallic probes 506, 508 in order to detect the system's fluid level. When at least one of the probes 506, 508 is not in contact with the fluid the impedance between the probes is high. When both probes 506, 508 are in contact with the fluid the impedance between the probes is low.

In one embodiment, the fluid level detection sensor comprises an oscillator 502 having an output, wherein the output is electrically coupled to the connecting end of the first probe 506 and a detector 504 having an input 514 and an output 516. The input 514 of the detector 504 is electrically coupled to the output 512 of the oscillator 502 and the connecting end of the first probe 506 for receiving a signal related to the measured impedance between the measuring end of the first probe 506 and the measuring end of the second probe 508 and the output 516 of the detector 504 generates an output signal.

Due to specific design constraints, a DC measurement of resistance is not practical because the application of a direct current causes a chemical reaction between the probes 506, 508 and the fluid that will plate one probe and erode the other. Therefore, due to the fore mentioned reason it is necessary function of the present invention that an AC measurement of resistance be executed within the system. When an AC measurement is performed, the probes 506, 508 behave as a series resistor-capacitor combination. The consequential capacitance value depends on the surface area of the probe that is in contact with the fluid. The resulting resistive component depends on the conductivity of the fluid and the separation of the probes 506, 508.

FIG. 6 illustrates an oscillator 600 that may be implemented within the present invention's sensor mechanism. The oscillator 600 of FIG. 6 is a relaxation oscillator that produces a square wave output. In order to remove the DC component of the output signal, the output of the oscillator 600 is coupled with a capacitor 602. Additionally, the output component contains a resistor 604 for setting the output impedance of the oscillator 600. It is intended that the output impedance be high so that the probes 506, 508 can easily shunt the signal to ground when in contact with the fluid.

In one embodiment, the oscillator 600 comprises a comparator 630 that is operably connected to an assortment of resistors 604, 606, 608, 614, 612, 616 and capacitors 602, 610. The oscillator 600 outputs an AC signal through the resistor 604. The AC signal transmitted through the resistor 604 may embody different forms such a square wave, a sinusoidal wave, or like. In the embodiment, as shown here, a square wave is utilized.

FIG. 7 illustrates the detector 700 component of the sensor of the present invention. The detector 700 utilizes a two-step process in order to sense the output signal of the oscillator 600. First, the detector 700 screens the transmitted signal based on amplitude. If the signal's amplitude exceeds the detector's 700 threshold, the signal is passed, if the signal's amplitude is below the detector's 700 threshold the signal is blocked. In the second step a frequency discriminator 704 is utilized in order to determine whether the signal was passed or blocked. If the signal is blocked the resultant frequency will be zero, otherwise the oscillator 600 frequency will be passed onto the frequency discriminator 704. Subsequently, the frequency discriminator 704 produces a logic low if the frequency is above a threshold and a logic high if the frequency is below the threshold.

In one embodiment, the detector 700 includes a field-effect transistor 702, resistors 712, 716, 720, 722, 724 and a capacitor 718. The field-effect transistor 702 comprises a drain 708, a gate 710 and a source 706, wherein the source 706 of the field-effect transistor 702 is grounded and the gate 710 is electrically coupled to the output of the oscillator 600, and a comparator 704 is electrically coupled to the drain 708. The field-effect transistor 702 receives an output signal having a frequency from the oscillator 600 output and allows the output signal to pass if the amplitude of the output signal is greater than a gate threshold voltage, and the frequency discriminator 704 receives the output signal and at the output generates a logic low if the frequency of the oscillator 600 output is higher than a threshold frequency, or a logic high if the frequency of the oscillator 600 output is lower than the threshold frequency, respectively. On the other hand, if the amplitude of the output signal is smaller than the threshold gate 710 voltage, the field-effect transistor 702 blocks the output signal. The detector 700 may further include a capacitor 714 that is electrically coupled between the output of the oscillator 600 and the gate 710 of the field-effect transistor 702.

Self-Test Circuitry

Figure 8:
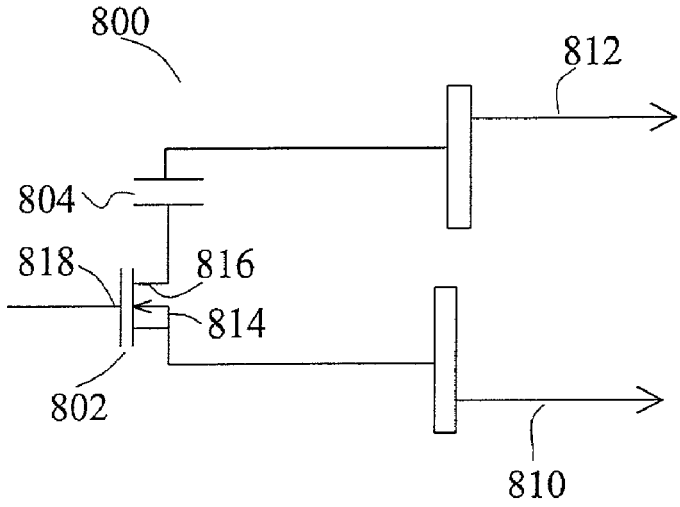
FIG. 8 is a block diagram for self-test circuit according to one embodiment of the present invention.

FIG. 8 illustrates a self-test circuit 800 that can be added to the sensor by combining a transistor 802 and capacitor 804 together to short the first probe 812 with the second probe 810. This allows a microprocessor (not shown) to check that the first 812 and second probe 810 are electrically connected to the circuit and that the circuit is functioning. Without the self-test capability, an unconnected probe would produce a low fluid indication. In such an instance, the microprocessor would not be able to determine when to stop filling, and thus resulting in an overfill and possibly a spillage of fluid. However, with the shorting feature the integrity of the sensor can be checked before starting a fill operation, therefore avoiding an undesirable fluid spill if the sensor is not operating properly.

In one embodiment, four wires connect the sensor circuit to the first 812 and second probe 810. Each probe has two wires, one for the sensor circuit and one for the self-test circuit 800. The probe forms the electrical contact between the two wires ensuring that if the self-test is successful, the wires must be connected to the probes. It is important to note that while each wire contacts the probe, they are isolated from each other by a non-conductive means such as a nylon washer. With such an arrangement, if any one of the four wires fails to make a conductive path between the probe and the circuit, the self-test will be unsuccessful.

The fail-safe circuit 800 has a transistor 802 having a drain 816, a gate 818 and a source 814 and a capacitor 804 electrically coupled between the drain 816 of the transistor 802 and the second wire of the first probe 812, wherein the source 814 of the transistor 802 is electrically coupled to the second wire of the second probe 810, and the gate 818 of the transistor 802 is adapted to receive a control signal. The nylon washer assures that any electrical continuity between the first and second wires occurs through the body of the probes.

Accordingly, the self-testing feature of the present invention if properly implemented ensures that overfilling of the device will be avoided. If the sensor output is stuck in a high state, no filling will ensue, since this is a full indication. If the sensor output is low, it will be tested to see that it can detect fluid before filling is allowed.

Operation of the Present Invention The algorithm utilized to implement the fluid level management system may best be described in three parallel processes. Each of the processes run concurrently and communicates to each other by the means of semaphores or flags. The three processes are 1) Fluid Level Determination, 2) the Main Printer Task, and 3) the Fill Task.

Figure 9A:
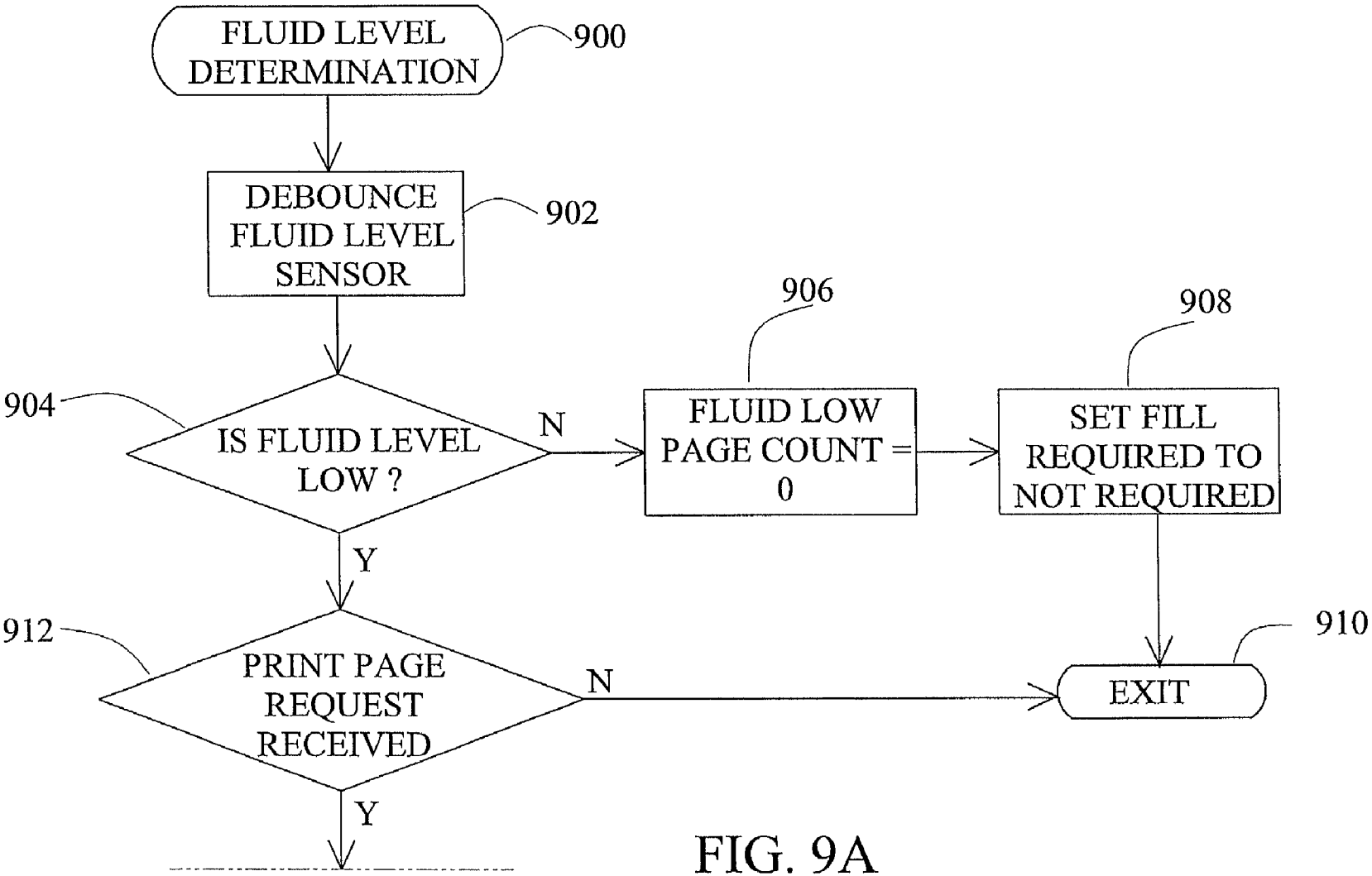
FIGS. 9A and 9B are a flow chart partially showing a process of determining the level of a fluid in a media coating system according to one embodiment of the present invention.
Figure 9B:
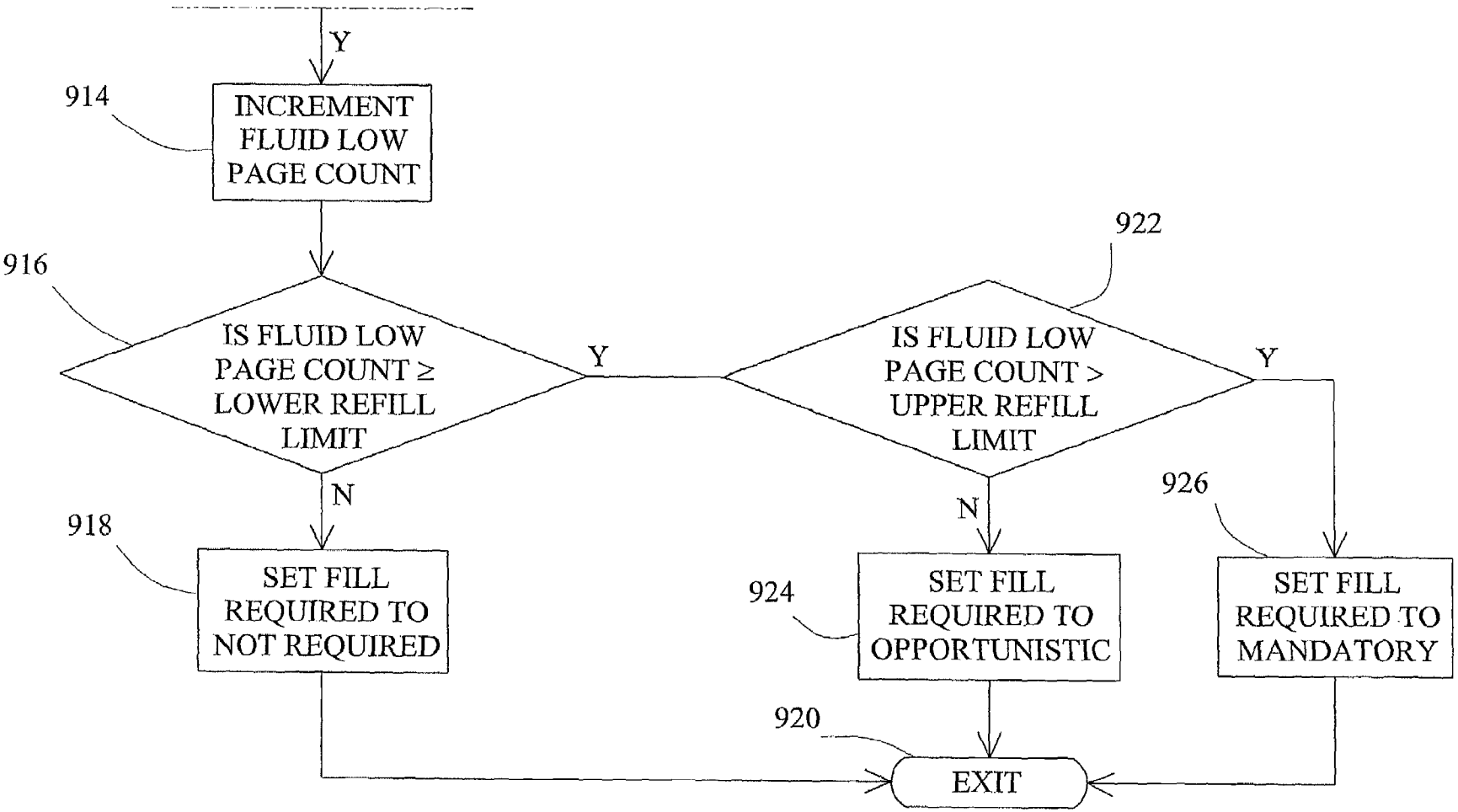

The Fluid Level Determination task, as shown in FIGS. 9A and 9B, begins execution at block 900. The primary function of this task is to determine the level of fluid in the applicator and if fill operations are required. The fluid level sensor is de-bounced at block 902 by looking for a predetermined number of successive identical reads. If the fluid level is determined not to be low at block 904, the fluid low page count is cleared at block 906. The fluid low page count is utilized to track the number of pages coated after the sensor has transitioned to the fluid low state. Given that the volume of fluid applied to each page is known, the fluid low page count is proportional to the volume of fluid used since the fluid level sensor transitioned to the fluid low state. Since the fluid level is not low, a fill is not required and the fill-required variable is set to the not required state at block 908. The Fluid Level Determination task then exits at block 910.

If the fluid level is determined to be low at block 904, block 912 determines if a print page request for the coating path has been received. If this request has not been received, the task exits at block 910. When block 912 determines that the request has been received, the fluid low page count is incremented at block 914. If the fluid low page count is determined not to be greater than or equal to a predetermined lower refill limit at block 916, the fill required variable is set to the not required state at block 918 and the task exits at block 920. If the fluid low page count is greater than the lower limit, the fluid low page count is compared against the upper refill limit at block 922. If the fluid low page count is determined to be greater than the lower refill limit and less than the upper refill limit, fill required is set to opportunistic at block 924 and then exits at block 920. This setting indicates that the system has used enough fluid to warrant a fill operation; however, the need to fill is not critical at this point. This fill operation should only take place during times when the printer throughput will not be affected. If the fluid low page count is determined to be greater than the upper refill limit, fill required is set to mandatory at block 926 and then exits at block 920. This indicates that the fluid level in the applicator has fallen close to a level at which coating performance will be degraded. The need for a fill operation has now become critical and a printer operation will be interrupted in order to execute this fill operation. Once the fill-required variable is set, the task exits at block 920.

Figure 10A:
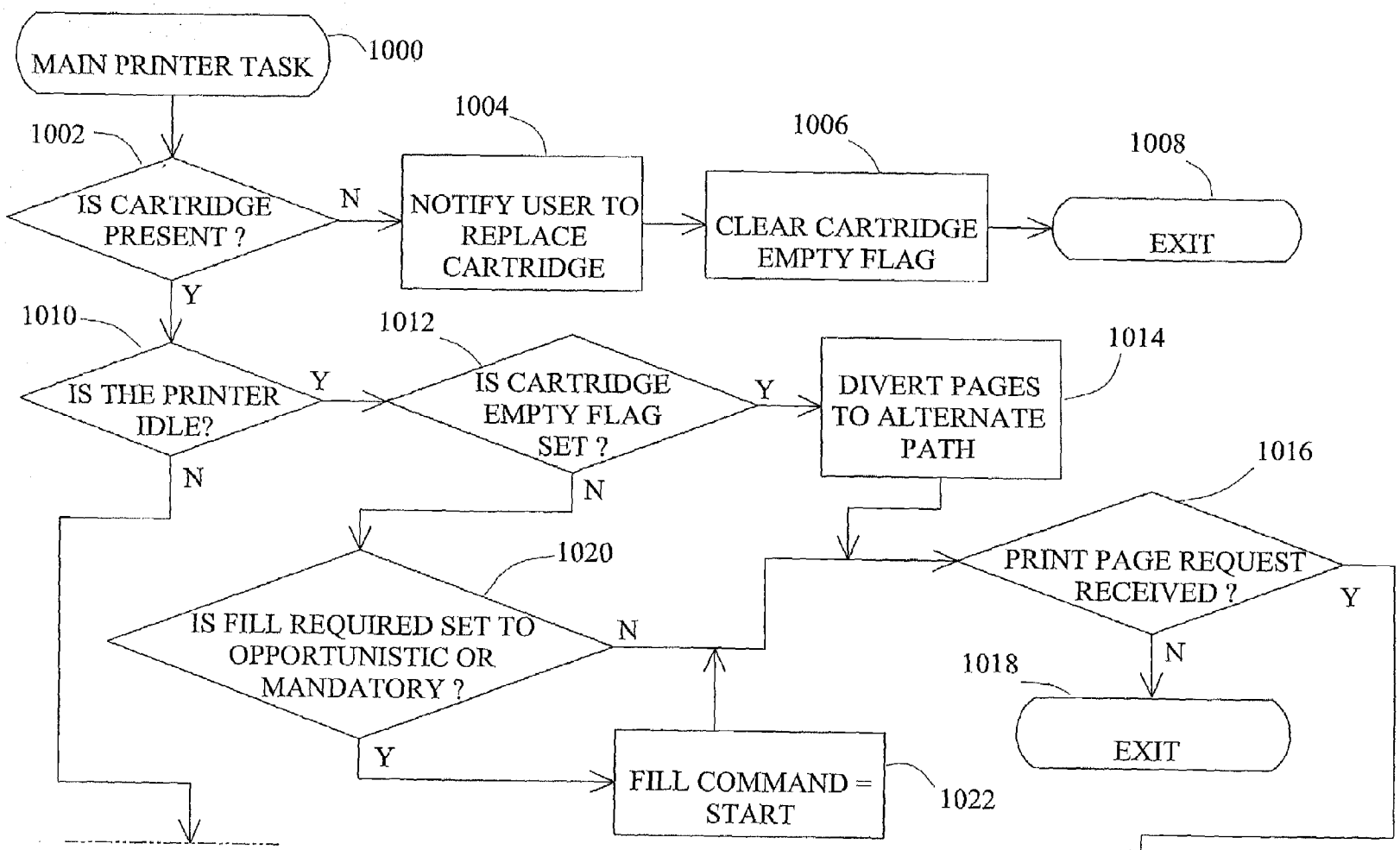
FIGS. 10A and 10B are a flow chart partially showing a process of filling a fluid in a media coating system according to one embodiment of the present invention.
Figure 10B:
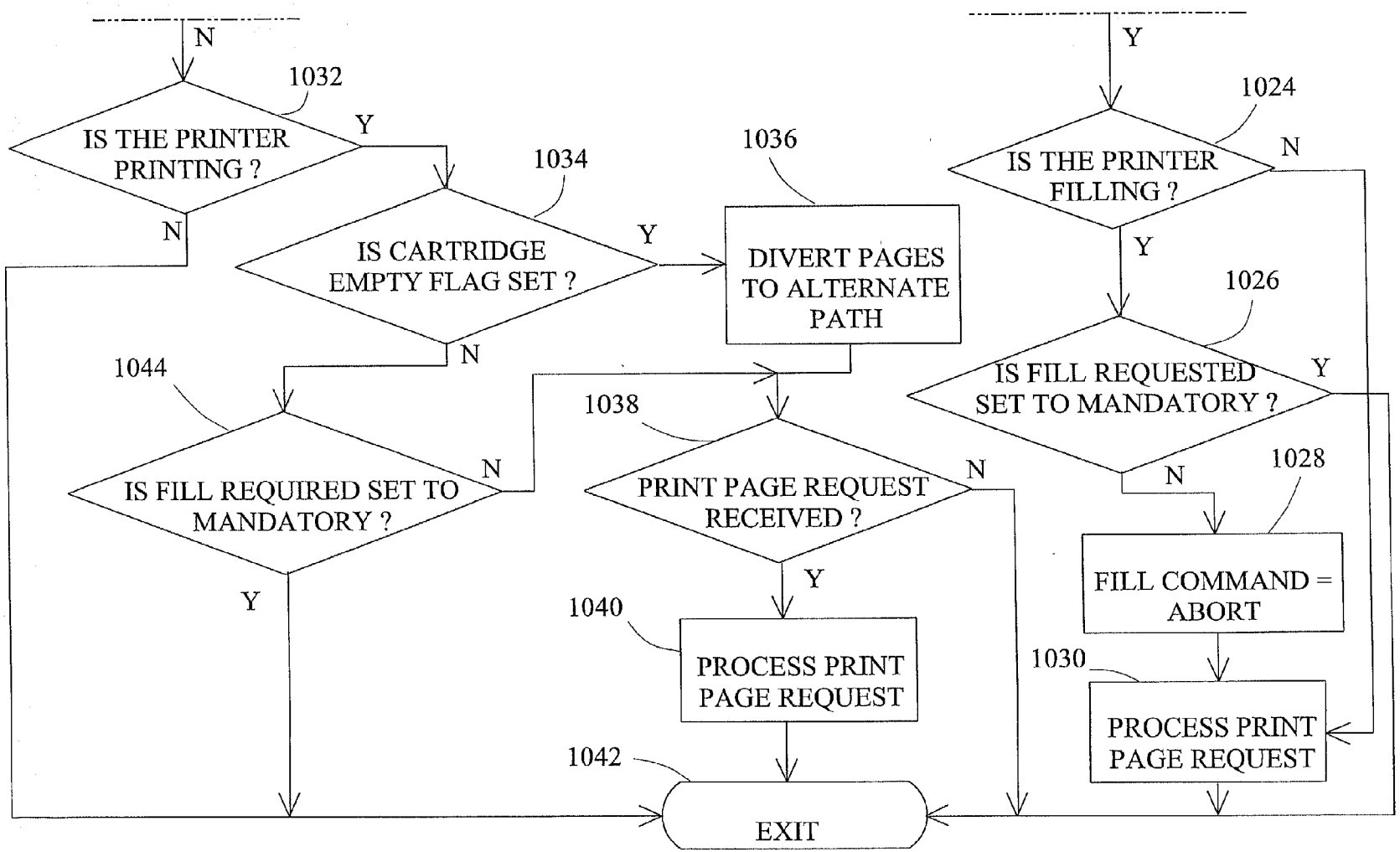

The Main Printer Task is shown in FIGS. 10A and 10B and begins execution at block 1000. This task initiates the fill operation based upon the printer status (idle or printing) and the level of urgency assigned to the fill-required variable. Before any decisions are made about initiating a fill operation, the cartridge present sensor is checked at block 1002. If the cartridge is not present, the user is notified to replace the cartridge at block 1004. The cartridge empty flag is cleared at block 1006. This flag is cleared at this point because this flag is meant to indicate the status of the cartridge currently installed in the printer. There is not a means to directly measure that a cartridge is empty. Once a cartridge has been removed from a printer, any information determined about that cartridge is no longer valid. If an empty cartridge is installed in a printer, the cartridge will be assumed to be full until it can be determined that it is empty. The task then exits at block 1008.

If the cartridge is detected at block 1002, the status of the printer is checked at block 1010. If the printer is idle (not printing), the status of the cartridge empty flag is ascertained at block 1012. If this flag is set, indicating that the cartridge is out of fluid, all printed pages are diverted to alternate path at block 1014. If a print page request is not received at block 1016, the task exits at block 1018. If the cartridge empty flag is not set at block 1012, block 1020 determines if an opportunistic or a mandatory fill is required. If yes, the fill command is set to start at block 1022 in order to initiate the Fill task. If a fill is not required at block 1020 or if the fill command has just been set at block 1022, the print page request is checked at block 1016. If a print page request has been received, block 1024 checks if the printer is currently executing a fill operation. If a fill operation is under way, block 1026 checks to see if this is a mandatory fill. Upon determination that the fill is not mandatory, the fill command is set to abort at block 1028 and the print page request is processed at block 1030. The task will then exit at block 1042. If the printer is not filling at block 1024, the print page request is processed and then task will then exit. When the fill is determined to be mandatory at block 1026, the print page request is not processed. This request will be left pending until the fill process is complete.

If the printer is not idle at block 1010, it is determined if the printer is running at block 1032. If the printer is running, the status of the cartridge empty flag is ascertained at block 1034. If this flag is set, indicating that the cartridge is out of fluid, all printed pages are diverted to alternate path at block 1036. If a print page request has been received at block 1038, it is processed at block 1040 and the task exits at block 1042. If the request has not been received, the task exits at block 1042. If the cartridge empty flag is not set at block 1034, block 1044 determines if a mandatory fill is required. If a mandatory fill is required, the task will exit at block 1042. This allows any pages that are currently be processed to be completed and prevents any new pages from being processed. The printer will return to the idle state after the pending pages are completed and the logic described above will initiate the mandatory fill. If a mandatory fill is not required at block 1044, the execution continues at block 1038 with checking for a print page request as previously described.

Figure 11A:
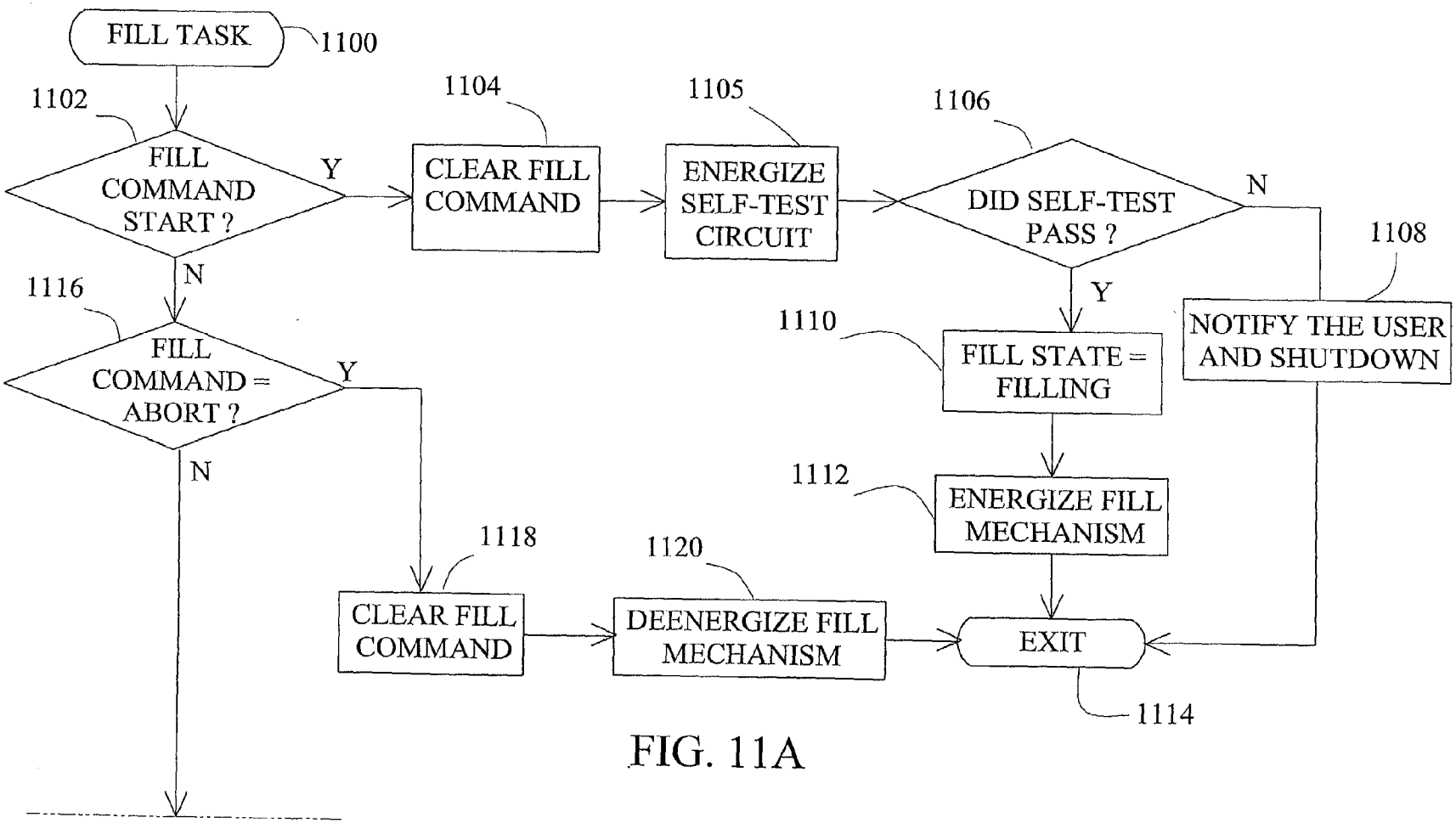
FIGS. 11A and 11B are a flow chart partially showing a process of filling a fluid in a media coating system according to one embodiment of the present invention.
Figure 11B:
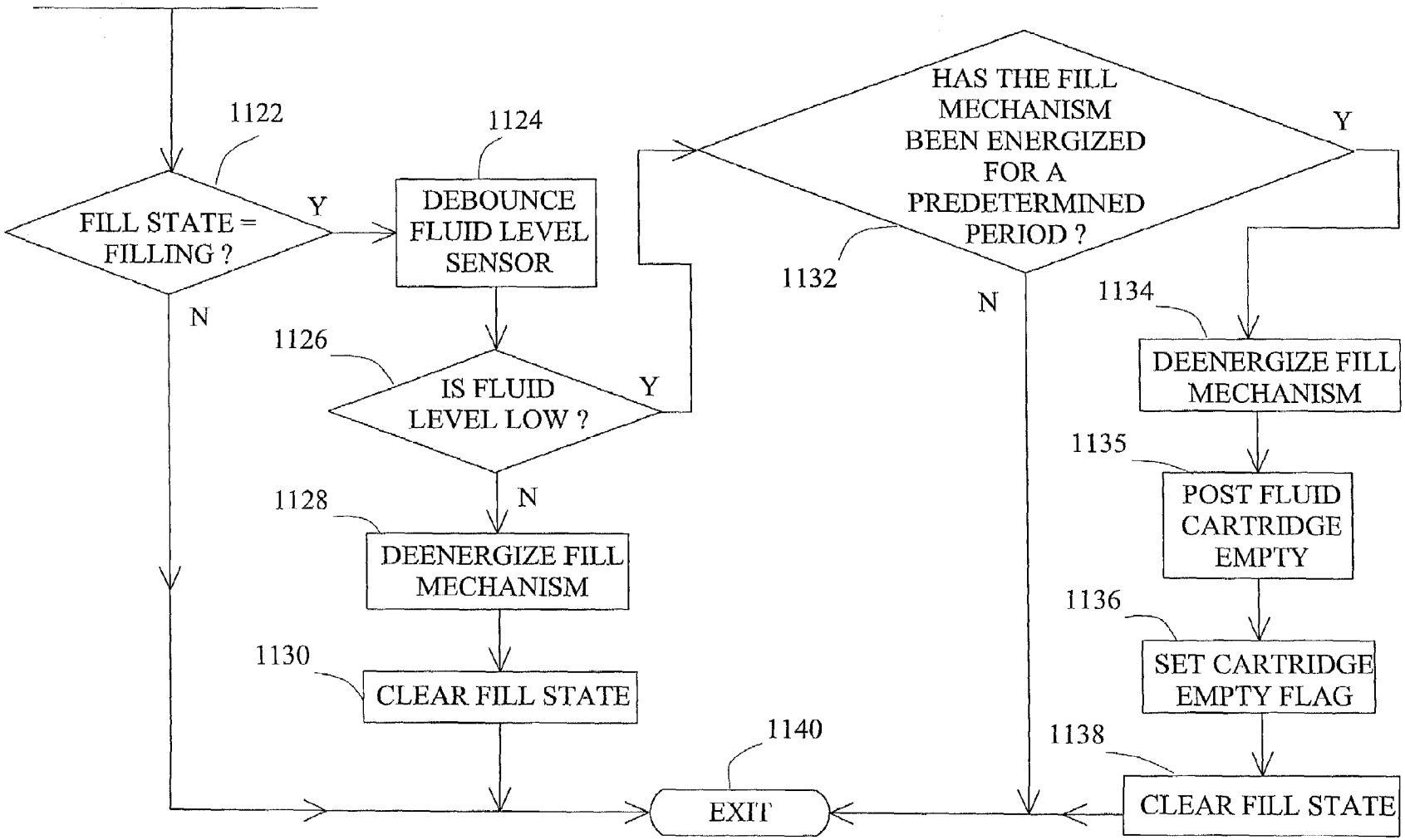

The Fill task is illustrated in FIGS. 11A and 11B. This task is intended to control the fill mechanism and determine if the cartridge is empty. Upon commencement of the Fill task at block 1100, a check for the fill command being set to start is made at block 1102. If successful, the fill command is cleared at block 1104 and the self-test circuit is energized at block 1105. If the self-test fails at block 1106, the user is notified of this error and the entire printer is shutdown at block 1108. The task is then complete and exits at block 1114. If the self-test passes at block 1106, the fill state is set to filling at block 1110 and the fill mechanism is energized at block 1112. The task then exits at block 1114.

If the fill command was not set to start at block 1102, block 1116 checks for the fill command being set to Abort. If the abort command is found, it is cleared at block 1118 and the fill mechanism is de-energized at block 1120 and the task exits at block 1114.

If the abort command is not found at block 1116, the status of the fill state is determined at block 1122. If the fill state is filling, the fluid level sensor is de-bounced at block 1124 and then the fluid level is checked at block 1126. If the fluid level is not low, the fill mechanism is de-energized at block 1128 and the fill state is cleared at block 1130 before the task exits at block 1140. If the fluid level is low at block 1126, the determination is made at block 1132 if the fill mechanism has been energized for a predetermined period. This predetermined period is set so that barring any failures, the fill mechanism will transfer sufficient fluid from the cartridge to the applicator to cause the fluid level sensor to detect the full fluid condition. If the fill mechanism has not been energized longer than the predetermined period, the fill operation is allowed to continue and the task exits at block 1140. If the predetermined period has been exceeded, the fill mechanism is de-energized at block 1134. Since the fill operation did not succeed, it is determined that the cartridge is empty. A message indicating this empty state is posted at block 1135 and an internal flag indicating that the currently installed cartridge is empty is set at block 1136. Finally, the fill state is cleared at block 1138 prior the task exiting at block 1140.

Once the Fill task has successfully transferred fluid from the cartridge to the applicator, the Fluid Level Determination task with detect that the fluid is no longer low and clear the fluid low page count and set the fill required to not required. If the Fill task is not successful, the Fill required will still be set, but the cartridge empty flag will prevent the Main Printer task from initiating another fill operation until the cartridge is removed and replaced.

Although the present invention has been described with reference to specific details of certain embodiments thereof, it is not intended that such details should be regarded as limitations upon the scope of the invention except as and to the extent that they are included in the accompanying claims.

What is claimed is:

1. A fluid level detection sensor for measuring a media coating fluid level in a media coating system, wherein the media coating system has an applicator with a trough to contain the media coating fluid and the fluid level detection sensor is located within the applicator, comprising:

a. a first probe made of conducting material having a connecting end, a measuring end and a body there between;

b. a second probe made of conducting material having a connecting end, a measuring end and a body therebetween, wherein the first probe and the second probe are spaced apart from each other such that an impedance between the measuring end of the first probe and the measuring end of the second probe can be measured;

c. an oscillator having an output, wherein the output is electrically coupled to the connecting end of the first probe; and d. a detector comprising:

a. an input and an output, wherein the input is electrically coupled to the output of the oscillator and the connecting end of the first probe for receiving signal related to the measured impedance between the measuring end of the first probe and the measuring end of the second probe and the output generates an output signal;

b. a field-effect transistor having a drain, a gate and a source, wherein the source of the field-effect transistor is grounded and the gate is electrically coupled to the output of the oscillator; and c. a frequency discriminator having an input electrically coupled to the drain of the field-effect transistor and an output, wherein the field-effect transistor receives an output signal having a frequency from the oscillator output and allows the output signal to pass if the amplitude of the output signal is greater than the gate threshold voltage, and the frequency discriminator receives the output signal and at the output generates a logic low if the frequency of the oscillator output is higher than a threshold frequency, or a logic high if the frequency of the oscillator output is lower than the threshold frequency, respectively.

2. The sensor of claim 1, wherein the connecting end of the second probe is coupled to ground.

3. The sensor of claim 1, wherein the first probe is shorter than the second probe.

4. The sensor of claim 1, wherein the conducting material includes a stainless steel.

5. The sensor of claim 1, wherein each of the measuring end of the first probe and the measuring end of the second probe has a surface contactable with the media coating fluid, and the impedance between the measuring end of the first probe and the measuring end of the second probe depends on the area of the surface of each of the measuring ends that is in contact with the media coating fluid.

6. The sensor of claim 5, wherein when at least one of the first probe and the second probe is not in contact with the media coating fluid within the trough of the applicator, the measured impedance between the measuring end of the first probe and the measuring end of the second probe is high.

7. The sensor of claim 5, wherein when both of the first probe and the second probe are in contact with the media coating fluid within the trough of the applicator, the measured impedance between the measuring end of the first probe and the measuring end of the second probe is low.

8. The sensor of claim 1, wherein the oscillator outputs an AC signal through a resistor and capacitor.

9. The sensor of claim 8, wherein the oscillator outputs an AC signal through the resistor in the form of a square wave.

10. The sensor of claim 8, wherein the oscillator comprises a comparator.

11. The sensor of claim 1, wherein if the amplitude of the output signal is smaller than the gate threshold voltage, the field-effect transistor blocks the output signal.

12. The sensor of claim 1, wherein the detector further comprises a capacitor electrically coupled between the output of the oscillator and the gate of the field-effect transistor.

13. The sensor of claim 1, further comprising a fail-safe circuit performing a closed-loop status verification test to verify if the fluid level detection sensor functions properly before the applicator is filled with the media coating fluid.

14. The sensor of claim 13, wherein the first probe has two wires, and the second probe has two wires, and the fail-safe circuit comprises:

a. a transistor having a drain, a gate and a source; and b. a capacitor electrically coupled between the drain of the transistor and a wire of the first probe, wherein the source of the transistor is electrically coupled to a wire of the second probe, and the gate of the transistor is adapted to receive a control signal.

15. The sensor of claim 14, wherein the two wires from each probe establishes conductivity only through the body of the probe.

16. The sensor of claim 15, further comprising at least one nylon washer to isolate the first and second wires of each probe from each other.

17. The sensor of claim 1, wherein each of the bodies of the first and second probes is substantially cylindrical.

18. A method for fluid level management in a media coating system, wherein the media coating system has an applicator with a trough to contain the media coating fluid, comprising the steps of:

a. determining media coating fluid level within the applicator against a predetermined upper refill limit and a predetermined lower refill limit, wherein the determining media coating fluid level step comprises:

i. measuring media coating fluid level within the applicator;

ii. generating a signal indicating that the fluid level is low if the media coating fluid level is lower than the predetermined upper refill limit;

iii. counting the number of pages coated since the fluid level reaches the predetermined upper refill limit; and iv. determining if a media coating request is received; and b. selectively transferring media coating fluid from a supply item to the trough of the applicator depending on the level of the media coating fluid against the predetermined upper refill limit and the predetermined lower refill limit and the status of the media coating system.

19. The method of claim 18, wherein the step of selectively transferring media coating fluid, when a media coating request is received, comprises the steps of:

a. holding a media coating operation responsive to the media coating request if the number of pages coated since the fluid level reaches the predetermined upper refill limit exceeds a first page number corresponding to the predetermined lower refill limit; and b. transferring media coating fluid from a supply item to the trough of the applicator.

20. The method of claim 18, wherein the step of selectively transferring media coating fluid, when a media coating request is received, comprises the steps of:

a. holding a media coating operation responsive to the media coating request if the number of pages coated since the fluid level reaches the predetermined upper refill limit is greater than the first page number corresponding to the predetermined upper refill limit but smaller than the second page number; and b. transferring media coating fluid from a supply item to the trough of the applicator when the media coating operation is accomplished.

21. The method of claim 20, wherein the step of transferring media coating fluid, when a media coating request is received, comprises the steps of:

a. holding the media coating operation responsive to the media coating page request once the number of pages coated is greater than the first page number corresponding to the predetermined lower refill limit; and b. transferring media coating fluid from a supply item to the trough of the applicator.

22. The method of claim 18, wherein the step of selectively transferring media coating fluid, when a media coating request is not received, comprises the steps of:

a. transferring media coating fluid from a supply item to the trough of the applicator if the number of pages coated since fluid level reaches the upper refill limit, is greater than the first page number corresponding to the predetermined upper refill limit.

23. The method of claim 18, further comprising the steps of:

a. detecting the presence of the supply item; and b. detecting the presence of the media coating fluid in the supply item.

24. The method of claim 23, further comprising the step of replacing the supply item with a new supply item if no media coating fluid is detected in the supply item.

25. The method of claim 23, where the step of detecting the presence of the supply item is accomplished by the use of an optical sensor.

26. The method of claim 18, further comprising the steps of using a fluid level detection sensor to measure media coating fluid level within the applicator and performing a closed-loop status verification test to ensure that the fluid level detection sensor is functioning properly before the step of transferring the media coating fluid from the supply item to the applicator is initiated.

27. The method of claim 26, wherein the fluid level detection sensor has a two probes configuration, and the step of using a fluid level detection sensor to measure media coating fluid level within the applicator is accomplished by measuring an impedance between the two probes.

28. The method of claim 18, wherein the media coating system comprises a printer.

29. The method of 28, wherein the media coating fluid includes ink and the media coating operation comprises a printing operation delivering the ink from the applicator to at least one sheet of paper.

30. The method of claim 18, wherein the media coating system comprises a copy machine.

31. The method of claim 18, wherein the media coating system comprises a fax machine.

32. A system for fluid level management in a media coating system used to coat a plurality of pages of media, wherein the media coating system has an applicator with a trough to contain the media coating fluid, comprising:

a. means for determining media coating fluid level within the applicator against a predetermined upper refill limit and a predetermined lower refill limit, wherein the means for determining the media coating fluid level comprises:

i. means for measuring media coating fluid level within the applicator;

ii. means for generating a signal indicating that the fluid level is low if the media coating fluid level is lower than the predetermined upper refill limit;

iii. means for counting the number of pages coated since the fluid level reaches the predetermined upper refill limit; and iv. means for determining if a media coating request is received; and b. means for selectively transferring media coating fluid from a supply item to the trough of the applicator depending on the level of the media coating fluid against the predetermined upper refill limit and the predetermined lower refill limit and the status of the media coating system.

33. The system of claim 32, wherein the means for selectively transferring media coating fluid, when a media coating request is received, performs the steps of:

a. holding a media coating operation responsive to the media coating request if the number of pages coated since the fluid level reaches the predetermined upper refill limit exceeds a first page number corresponding to the predetermined lower refill limit; and b. transferring media coating fluid from a supply item to the trough of the applicator.

34. The system of claim 33, wherein the means for selectively transferring media coating fluid, when a media coating request is not received, performs the step of transferring media coating fluid from a supply item to the trough of the applicator if the number of pages coated is greater than the first page number corresponding to the predetermined upper refill limit.

35. The system of claim 32, wherein the means for selectively transferring media coating fluid, when a media coating request is received, performs the steps of:

a. performing a media coating operation responsive to the media coating request if the number of pages coated since the fluid level reaches the predetermined upper refill limit is greater than the first page number corresponding to the predetermined upper refill limit but smaller than first second page number; and b. transferring media coating fluid from a supply item to the trough of the applicator when the media coating operation is accomplished.

36. The system of claim 35, wherein the means for selectively transferring media coating fluid, when a media coating request is received, performs the steps of:

a. holding the media coating operation responsive to the media coating page request once the number of pages coated is greater than the first page number corresponding to the predetermined lower refill limit; and b. transferring media coating fluid from a supply item to the trough of the applicator.

37. The system of claim 32, further comprising:

a. means for detecting the presence of the supply item; and b. means for detecting the presence of the media coating fluid in the supply item.

38. The system of claim 32, wherein the means for detecting the presence of the supply item comprises an optical sensor.

* * * * *